US006752480B2

(12) United States Patent
Watanabe

(10) Patent No.: US 6,752,480 B2
(45) Date of Patent: Jun. 22, 2004

(54) INTEGRATED-CIRCUIT APPARATUS AND INK JET RECORDING APPARATUS USING THE SAME

(75) Inventor: Masahiko Watanabe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/919,902

(22) Filed: Aug. 2, 2001

(65) Prior Publication Data

US 2002/0024545 A1 Feb. 28, 2002

(30) Foreign Application Priority Data

Aug. 7, 2000 (JP) ..... 2000-238378

(51) Int. Cl.[7] ..... B41J 29/38
(52) U.S. Cl. ..... 347/5; 347/9; 347/20
(58) Field of Search ..... 347/9, 20, 5, 57–59, 347/128, 247; 327/143; 714/13, 23, 25, 36, 47

(56) References Cited

U.S. PATENT DOCUMENTS 4,270,167 A * 5/1981 Koehler et al. ..... 364/200
5,583,987 A * 12/1996 Kobayashi et al. ..... 714/13
5,734,280 A * 3/1998 Sato ..... 327/143
5,784,080 A * 7/1998 Nitta et al. ..... 347/23
5,801,561 A * 9/1998 Wong et al. ..... 327/143
5,929,672 A * 7/1999 Mitani ..... 327/143
6,033,050 A * 3/2000 Morita et al. ..... 347/23

FOREIGN PATENT DOCUMENTS

JP 02001100873 A * 4/2001 ..... G06F/3/00

* cited by examiner

*Primary Examiner*—Hai Pham
*Assistant Examiner*—Lam Nguyen
(74) *Attorney, Agent, or Firm*—Fitzpatrick, Cella, Harper & Scinto

(57) ABSTRACT

A large-scale integrated-circuit apparatus includes a CPU and a plurality of circuit blocks to be operated in accordance with clock signals. The circuit blocks receive reset signals to perform initialization and output reset completion signals. The CPU logic-operates the initialization completion signals output from the circuit blocks and outputs a signal for canceling resetting to the circuit blocks in accordance with the logic-operation result.

16 Claims, 11 Drawing Sheets

INTEGRATED-CIRCUIT APPARATUS AND INK JET RECORDING APPARATUS USING THE SAME

BACKGROUND OF THE INVENTION

1. Field of the Invention

The present invention relates to a large-scale integrated-circuit apparatus, particularly to a large-scale integrated-circuit apparatus comprising a plurality of circuits to be initialized when an electrical power source is turned on.

An application specific integrated circuit (hereafter referred to as ASIC) has been developed so far which is not a general-purpose IC such as a CPU or a memory but an IC for realizing a function most suitable for a specific purpose.

Because the semiconductor-integrated-circuit art has been recently developed, the operation speed, integration degree, and scale of the ASIC of this type have been improved and moreover, each circuit constituting the ASIC has been developed from a circuit having a single function to a circuit having multiple functions.

2. Related Background Art

In the case of an ASIC, at least three types of circuits such as a CPU, a peripheral logic circuit, and an application specific logic circuit have been independently improved in integration degree, operation speed, and scale. However, because the semiconductor-integrated-circuit art for a one-chip configuration including every function in the same chip has been recently established, further-advanced integration is realized. Also in the case of an ASIC, a CPU, a peripheral logic circuit, and an application specific logic circuit are integrated on one semiconductor wafer by the semiconductor-integrated-circuit art for realizing a one-chip configuration.

SUMMARY OF THE INVENTION

The above semiconductor integrated circuit greatly advanced in integration samples an external input signal in accordance with an external clock signal and captures it. Moreover, an internal circuit operates by converting an external clock signal into a sync signal.

As described above, in the case of a conventional BASIC advanced in integration, though a plurality of circuits mounted on a semiconductor wafer respectively synchronize with an external clock signal, each circuit only independently functions.

That is, though a circuit operation synchronizes with a clock, the reset operation (initialization) of each circuit when an electrical power source is turned on is independently performed. Therefore, a slight difference occurs between reset timings of the circuits and this makes operations of an ASIC unstable.

The above mentioned is described below by referring to FIG. 11 showing a block diagram of a conventional ASIC. Symbol 101 denotes an ASIC. A CPU 102, a peripheral logic circuit 103, and an application specific logic circuit 104 are set in the ASIC 101. The peripheral logic circuit 103 controls transfer of data between a memory (not shown) built in the ASIC 101, a program ROM (not shown) set to the outside of the ASIC 101, and the application specific logic circuit 104 on one hand and the CPU 102 on the other. The application specific logic circuit 104 is a logic circuit to be set to a specific control unit on which the ASIC 101 is mounted by a user in order to optimize the ASIC 101.

Symbol 105 denotes a clock signal supplied from an external unit to the ASIC 101, which is used to synchronize internal circuits of the ASIC 101. Symbol 106 denotes a reset signal supplied from an external unit to the ASIC 101. Symbol 107 denotes an inverter circuit set in the ASIC 101 to logic-invert the reset signal 106.

In the case of the above conventional ASIC 101, when the reset signal 106 is input for a predetermined period in accordance with rise of an electrical power source, an internal reset signal 108 obtained by inverting the reset signal 106 is input to reset terminals of the CPU 102, peripheral logic circuit 103, and application specific logic circuit 104. The CPU 102, peripheral logic circuit 103, and application specific logic circuit 104 are initialized by receiving the internal reset signal 108.

However, because a difference occurs between rises of voltages of the CPU 102, peripheral logic circuit 103, and application specific logic circuit 104 after start of power supply, reset timings of the circuits 102, 103, and 104 are slightly different from each other. Therefore, the reset timing of the CPU 102 may be later than the reset timings of the peripheral logic circuit 103 and the application specific logic circuit 104. In this case, a problem occurs that stable operations of the ASIC 101 cannot be expected.

The present invention is made to solve the above problems and its object is to provide a large-scale integrated-circuit apparatus for controlling the reset timing of each circuit to a proper value when initializing a plurality of circuits constituting an ASIC.

DESCRIPTION OF THE PREFERRED EMBODIMENTS

Embodiments of the present invention are described below by referring to the accompanying drawings.

Figure 1:
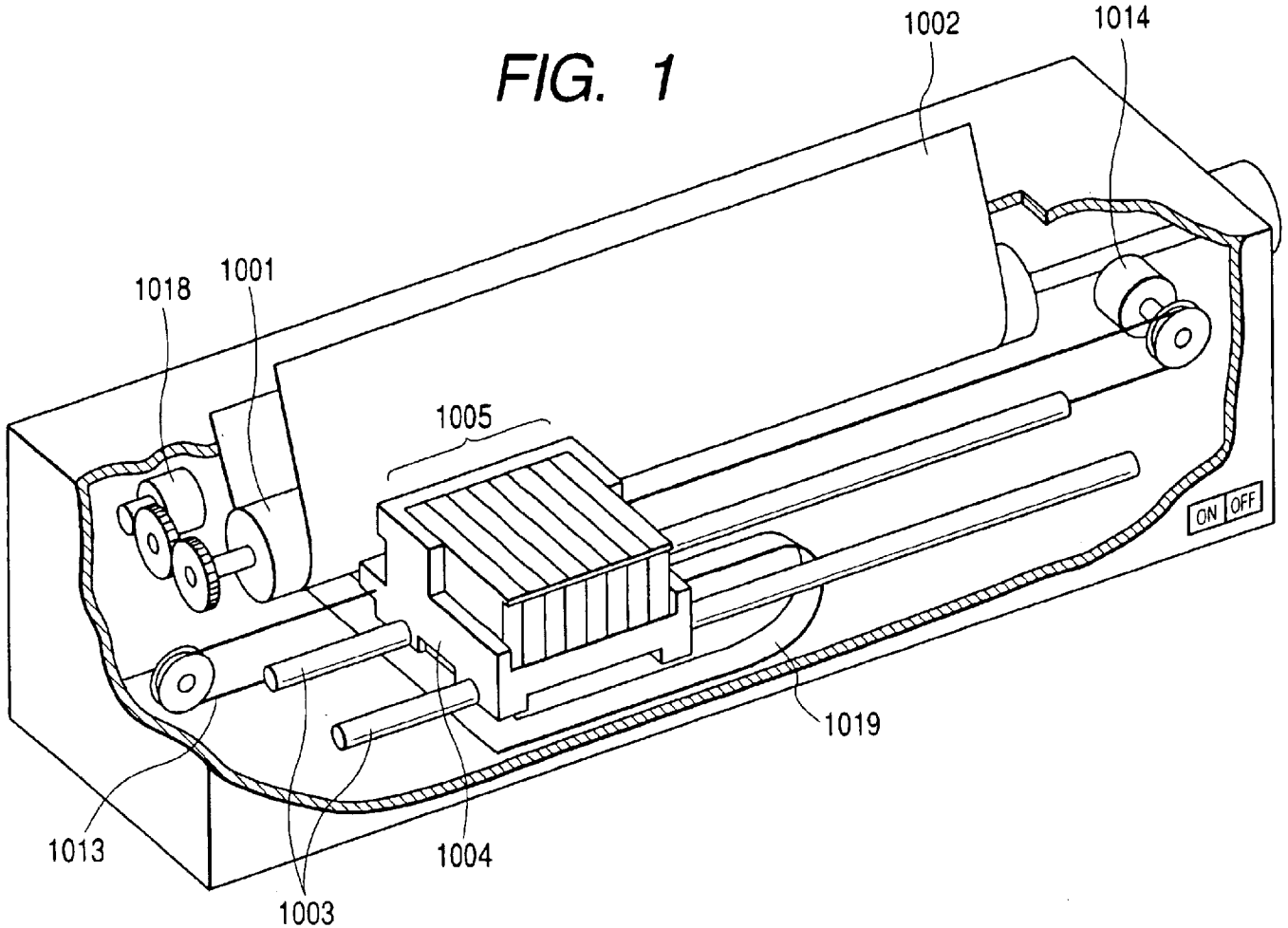
FIG. 1 is a perspective view of a printer of the present invention.

FIG. 1 is a perspective view of a printer to which an integrated circuit of the present invention can be applied. Symbol 1005 denotes a recording head which is mounted on a carriage 1004 so that it can be reciprocated in the longitudinal direction along shafts 1003 mounted on the carriage 1004.

The ink discharged from the recording head reaches a recording material 1002 whose recording surface is controlled by a platen 1001 at a short distance from the recording head to form an image on the material 1002.

A discharge signal is supplied to the recording head in accordance with image data through a flexible cable 1019. Symbol 1014 denotes a carriage motor for making the carriage 1004 scan along the shafts 1003. Symbol 1013 denotes a wire for transferring the driving force of the motor 1014 to the carriage 1004. Symbol 1018 denotes a carrying motor for carrying the recording material 1002 by combining with the platen roller 1001.

The recording head has a resolution of 600 DPI. The recording head is the ink jet type in which 128 recording elements are arranged. A recording element is constituted of a driving part and a nozzle and the driving part can supply heat to ink by a heater. Ink is film-boiled by the heat and discharged through a nozzle by a pressure change caused by growth or shrinkage of bubbles due to the film boiling.

Figure 2:
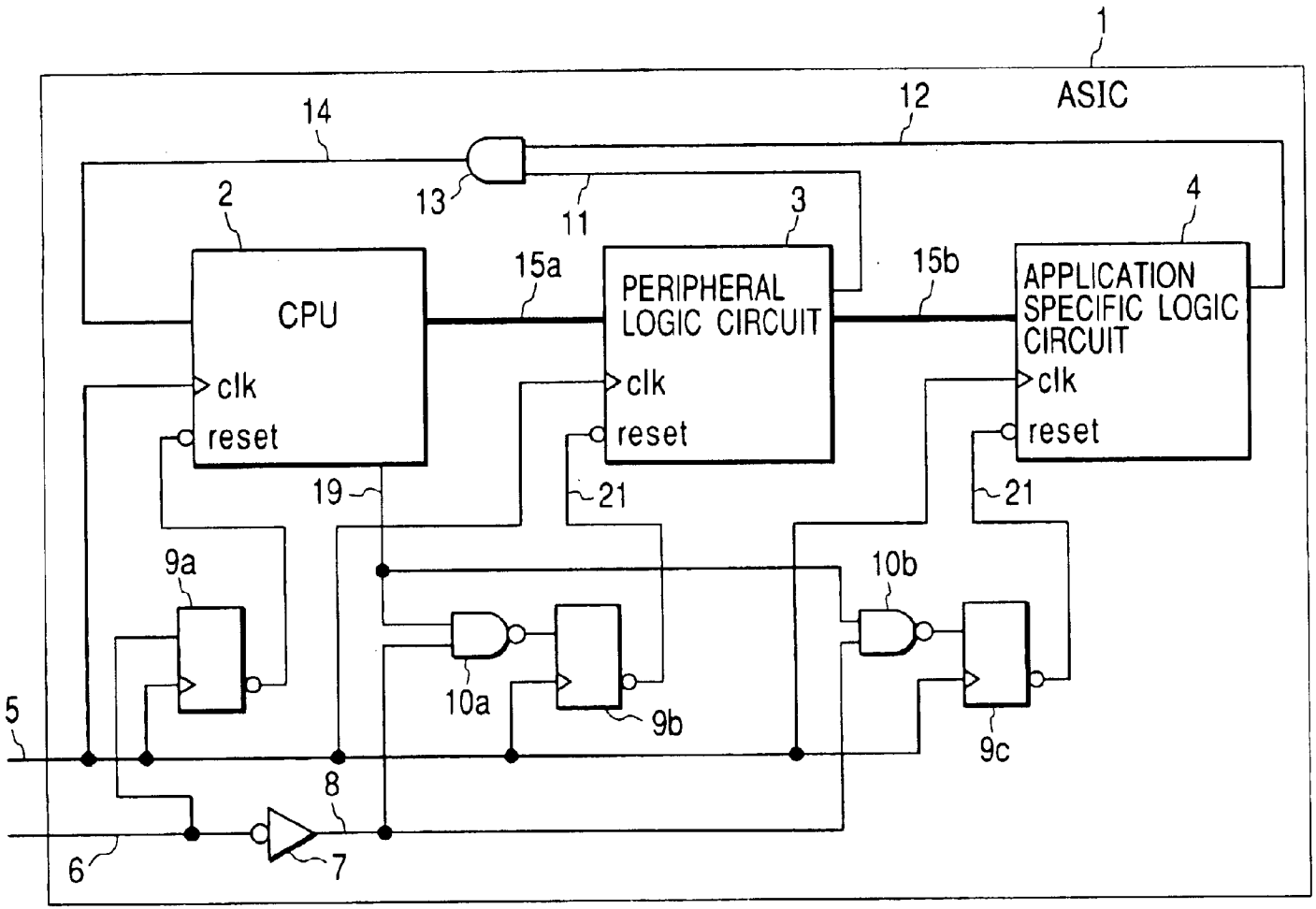
FIG. 2 is a block diagram showing a configuration of a first embodiment.

FIG. 2 is a block diagram showing a configuration of a first embodiment of an integrated-circuit apparatus of the present invention.

Symbol 1 denotes an ASIC (application specific integrated circuit). Symbol 2 denotes a circuit block serving as a CPU set in the ASIC 1.

Symbol 3 denotes a circuit block serving as a peripheral logic circuit set in the ASIC 1. The peripheral logic circuit 3 is a logic circuit for transferring data between a memory (not shown) built in the ASIC 1, a program ROM (not shown) set to the outside of the ASIC 1, and an application specific logic circuit 4 on one hand and the CPU 2.

Symbol 4 is a circuit block set in the ASIC 1, which serves as the application specific logic circuit. The application specific circuit 4 processes the print data received from a host computer 46. For example, the circuit 4 develops compressed print data on a memory or rearranges data in accordance with the arrangement of recording elements at a high speed.

Moreover, the application specific logic circuit generates a motor control signal. The control signal is output to a motor driving circuit. The control signal serves as a signal for the rotational direction or rotational speed of a motor. A carriage having a recording head smoothly reciprocates in accordance with the signal. Moreover, the application specific logic circuit generates a plurality of control signals for controlling the recording head. These control signals control the driving time and driving cycle of the recording elements in the recording head. The recording elements can perform proper driving in accordance with the control signals. A control signal to be sent to the recording head is out put at a preferable timing correspondingly to the operation of the carriage. Moreover, the control signal also includes an initialization signal for initializing a control circuit built in the recording head. The application specific logic circuit has a scale of approximately hundreds of thousands of gates.

Symbols 15*a* and 15*b* denote data buses used to transfer data between the CPU 2, peripheral logic circuit 3, and application specific logic circuit 4.

Arrangement of the ASIC 1 is described below. The distance between the specific logic circuit 4 and the CPU 2 is larger than the distance between the peripheral logic circuit 3 and the CPU 2 as shown in FIG. 2. That is, the specific logic circuit 4 is more separate from the CPU than the peripheral logic circuit 3.

Symbol 5 denotes a clock signal supplied from an external unit to the ASIC 1, which is used to synchronize internal circuits of the ASIC 1. Symbol 6 denotes a reset signal supplied from an external unit to the ASIC 1, which is used to initialize the CPU 2 in the ASIC 1. The reset signal 6 is high active. Symbol 7 denotes an inverter circuit set in the ASIC 1 to logic-invert the reset signal 6. Symbol 8 denotes the inverted signal,of the reset signal 6, which is an internal reset signal to be transferred to logic circuits 3 and 4 in the ASIC 1.

Symbols 9*a*, 9*b*, and 9*c* denote flip-flop circuits (hereafter referred to as F/F circuits). The F/F circuit 9*a* is a circuit for clock synchronizing the reset signal 6 and the F/F circuits 9*b* and 9*c* are circuits for clock-synchronizing output signals of inverting AND circuits 10*a* and 10*b* to be described later. An output signal of the F/F circuit 9*a* is supplied to a reset terminal of the CPU 2. Output signals of the F/F circuits 9*b* and 9*c* are supplied to ENB terminals of the peripheral logic circuit 3 and application specific logic circuit 4.

Symbol 11 denotes an initialization-completion signal output from the peripheral logic circuit 3 when initialization of the peripheral logic circuit 3 is completed. Symbol 12 denotes an initialization-completion signal output from the application specific logic circuit 4 when initialization of the application specific logic circuit 4 is completed.

Symbol 13 denotes an AND (logic) circuit which obtains the logical product between the initialization-completion signals 11 and 12 and communicates the result to the CPU 2 as an initialization-completion notification signal 14. The CPU receives the initialization-completion notification signal and outputs an enable permission signal 19.

Symbols 10*a* and 10*b* denote inverting AND circuits, which compute the inverting AND between an internal reset signal 8 and an enable permission signal 19 sent from the CPU 2 and supply the result to the F/F circuits 9*b* and 9*c*.

Symbol 21 denotes an enable signal for permitting operations of the peripheral logic circuit 3 and application specific logic circuit 4. When the enable permission signal 19 is output from the CPU 2 to the F/F circuit 9*b*, the enable signal 21 is output to the peripheral logic circuit 3 to cancel resetting of the peripheral logic circuit 3. Moreover, the enable, permission signal 19 is output from the CPU 2 to the F/F circuit 9*c* and the enable signal 21 is output from the F/F circuit 9*c* to the application specific logic circuit 4 to cancel resetting of the application specific logic circuit.

As described above, when the CPU cancels resetting in accordance with initialization completion signals output from the peripheral logic circuit and application specific circuit, the CPU resets each circuit block at a proper timing.

Operations of the ASIC 1 having the above configuration are described below. First, when power is supplied from an electrical power source unit (refer to FIG. 3) to the ASIC 1, a reset IC 39 (refer to FIG. 3 monitors the power-source voltage, generates the reset signal 6 to be kept at High level (hereafter referred to as H level) only for a predetermined period (e.g. 100 ms) after start of power supply and outputs the signal 6 to the ASIC 1.

When the reset signal 6 is supplied from the reset IC to the ASIC 1, the F/F circuit 9*a* clock-synchronizes the reset signal 6. The clock-synchronized reset signal is supplied to the reset terminal of the CPU 2 and the CPU 2 is initialized.

The peripheral logic circuit 3 and application specific logic circuit 4 are initialized in accordance with the clock signal 5. After the peripheral logic circuit 3 and application specific logic circuit 4 are initialized, the circuits 3 and 4 output initialization completion signals 11 and 12. When both initialization completion signals 11 and 12 are input to the AND circuit 13, the circuit 13 outputs the initialization-completion notification signal 14 to the CPU 2. The CPU 2 receives the initialization-completion notification signal 14 and outputs the enable permission signal 19.

The reset signal 6 supplied from the reset IC is inverted by the inverter circuit 7 and supplied to the inverting AND circuits 10*a* and 10*b* as the internal reset signal 8.

The inverting AND circuits 10*a* and 10*b* receive the enable permission signal 19 from the CPU 2 and output an H level signal to the F/F circuits 9*b* and 9*c* when the internal reset signal 8 is kept at Low level (hereafter referred to as L level), that is, the reset signal 6 is kept at H level.

The F/F circuits 9*b* and 9*c* receiving the H level signals synchronize the H level enable signal 21 in accordance with the clock signaled and supply the signal 21 to ENB terminals of the peripheral logic circuit 3 and application specific logic circuit 4. As a result, resetting of the peripheral logic circuit 3 and application specific logic circuit 4 is canceled.

When the initialization-completion signal 14 is not supplied from the AND circuit 13 to the CPU 2, the CPU 2 outputs the enable permission signal again for a certain period to attempt initialization of the peripheral logic circuit 3 and application specific logic circuit 4.

After the CPU confirms that the peripheral logic circuit 3 and application specific logic circuit 4 are initialized, it outputs an enable signal to operate the peripheral logic circuit 3 and application specific logic circuit 4.

In this case, the application specific logic circuit 4 outputs an initialization signal to the control circuit of the recording head and the driving circuit for driving a motor.

Figure 3:
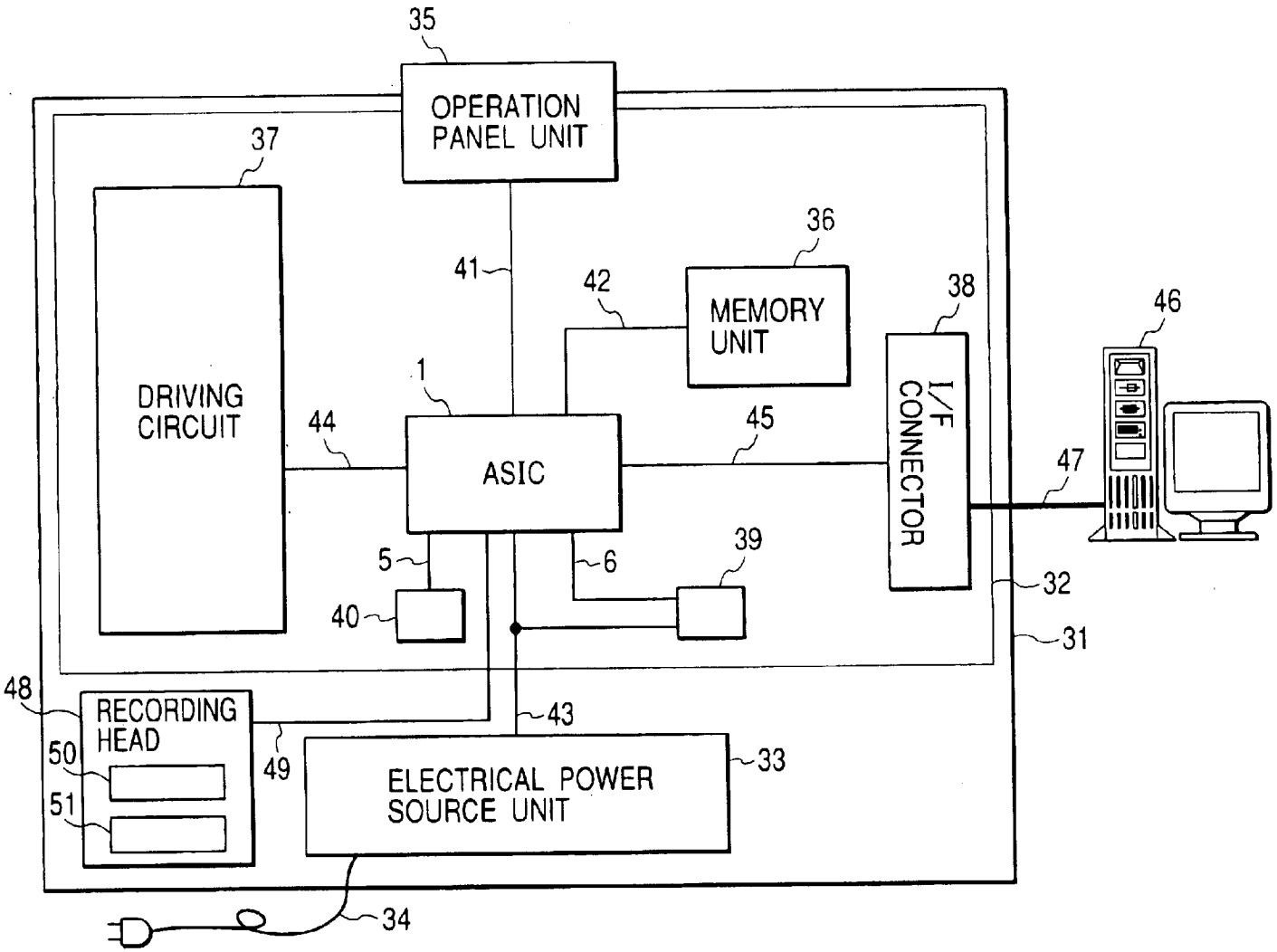
FIG. 3 is a block diagram showing a configuration of a printer having an ASIC 1.

A case of mounting the ASIC 1 on a printer is described below. FIG. 3 is a block diagram showing a configuration of a printer 31 on which the ASIC 1 is mounted.

Symbol 32 denotes a wiring board on which an electric circuit for driving the printer 31 is mounted. The ASIC 1 is mounted on the wiring board 32. Symbol 33 denotes an electrical-power-source unit that supplies power to the electric circuit on the wiring board 32 and driving units (not shown) through the electric circuit.

Symbol 34 denotes an AC cable for supplying commercial power to the electrical-power-source unit 33. Symbol 35 denotes an operation panel unit that is used by a user to operate the printer 31. Symbol 36 denotes a memory unit mounted on the wiring board 32, which temporarily stores information sent from the ASIC 1 and supplies the stored information to the ASIC 1.

Symbol 37 denotes a driving circuit for controlling operations of driving parts (not shown) in the printer 31. The driving circuit has a motor driving circuit. A carriage motor and a carrying motor are operated in accordance with a control signal output from the ASIC 1.

Symbol 38 denotes an I/F connector. The printer 31 receives print data from a host computer 46 serving as an external unit of the printer 31 through the I/F connector 38. Moreover, the printer 31 supplies the set information of the printer 31 to the host computer 46 through the I/F connector.

Symbol 39 denotes a reset IC which monitors a power-source voltage supplied from the electrical-power-source unit 33 and outputs the reset signal 6 to be kept at H level for a predetermined period (e.g. 100 ms) after power supply is started. The predetermined period is set to a period necessary for internal circuits of the ASIC 1 to reach a sufficiently operable state.

Symbol 40 denotes a clock generation circuit that generates the clock signal 5 for operating the ASIC 1 at a predetermined time interval. Symbol 41 denotes an operation bus for connecting the operation panel unit 35 with the ASIC 1, which sends the information supplied from the operation panel unit 35 to the ASIC 1. Moreover, the circuit 40 displays the information supplied from the ASIC 1 on the operation panel unit 35 through the bus 41.

Symbol 42 denotes a memory bus for connecting the memory unit 36 with the ASIC 1, which writes the information supplied from the ASIC 1 in the memory unit 36 and reads information from the memory unit 36 to the ASIC 1.

Symbol 43 denotes a DC line for connecting the electrical-power-source unit 33 with the ASIC 1 and reset IC 39 to supply DC power. The DC lines 43 includes a logic-circuit power-source line for operating the ASIC 1 and the like and a driving-circuit power-source line for operating the driving circuit 37. The voltage of the driving-circuit power-source line is higher than that of the logic-circuit power-source line.

Symbol 44 denotes a driving bus for connecting the ASIC 1 with the driving circuit 37, which transfers a driving signal from the ASIC 1 to the driving circuit 37.

Symbol 45 denotes an I/F bus for connecting the ASIC 1 with the I/F connector 38, which transfers the print data generated by the host computer 46 to the ASIC 1 and the information supplied from the printer 31 to the host computer 46.

Symbol 47 denotes an I/F cable for transferring print data from the host computer 46 to the printer 31.

Symbol 48 denotes a recording head. Symbol 49 denotes a flexible cable. Symbol 50 denotes a recording-unit control circuit and 51 denotes a recording-unit driving circuit. A control signal for driving the recording head is supplied from the ASIC 1 to the recording-unit control circuit through the flexible cable.

When an initialization signal is supplied from the ASIC 1 to a control circuit in the recording head, the control circuit in the recording head is initialized.

Operations of the printer 31 are described below. The printer 31 is operated by inserting the AC cable 34 into a commercial-power-source outlet. First, by inserting the AC cable 34 into the outlet, the power-source unit 33 converts AC (commercial power) into a DC power-source voltage (logic-circuit power-source voltage and driving-circuit power-source voltage) used for the printer 31 and outputs the voltage to the DC line 43.

The DC line 43 is connected to the ASIC 1 and reset IC 39 to drive the ASIC 1 and reset IC 39. In this case, the reset IC 39 always monitors the supply voltage of the DC line 43 and when detecting that power is supplied, it outputs the reset signal 6 to be kept at H level for a predetermined period (e.g. 100 ms) after detecting that the power is supplied to the ASIC 1.

The above predetermined period is set to a period necessary for internal circuits of the ASIC 1 to reach a sufficiently operable state. Operations of the ASIC 1 to which the reset signal 6 is supplied are performed as previously described with respect to FIG. 2.

Figure 4:
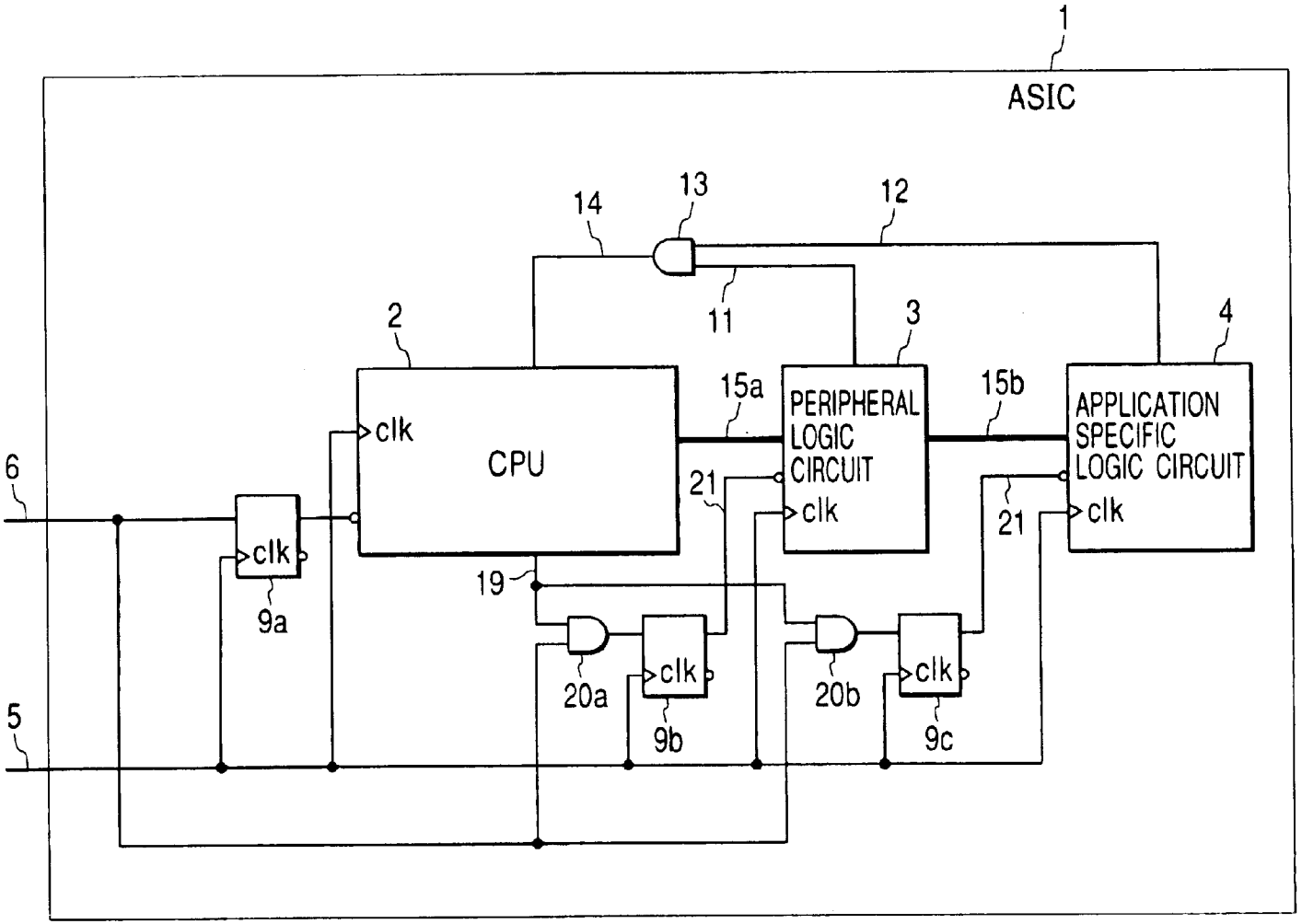
FIG. 4 is a block diagram showing a configuration of a second embodiment of the present invention.

FIG. 4 is a block diagram showing a configuration of a second embodiment. In FIG. 4, each circuit component functioning similarly to a corresponding component of the previously described embodiment is identified by the same reference numeral and its description is omitted.

Symbol 6 denotes a reset signal supplied from an external unit. The reset signal 6 is Low-active. The reset signal 6 is kept at Low level (hereafter referred to as L level) only for a predetermined period (e.g. 100 ms) after start of power supply and output to the ASIC 1.

When the reset signal 6 is input, the F/F circuit 9*a* clock-synchronizes the reset signal 6. The clock-synchronized signal is input to the reset terminal of the CPU 2 and the CPU is initialized.

Moreover, the peripheral logic circuit 3 and application specific logic circuit 41 are initialized to output initialization completion notification signals 11 and 12. As a result, the AND circuit 13 outputs the initialization-completion notification signal 14 to the CPU.

Then, the CPU 2 outputs the enable permission signal 19 to AND circuits 20*a* and 20*b*. The AND circuits 20*a* and 20*b* respectively compute a logical product with the reset signal 6 and output the logical product to the F/F circuits 9*b* and 9*c*.

The F/F circuit 9*b* outputs the enable signal 21 to the ENB terminal of the peripheral logic circuit 3 and the F/F circuit 9*c* outputs the enable signal 21 to the ENB terminal of the application specific logic circuit 4. The peripheral logic circuit 3 and application specific logic circuit 4 respectively receive the enable signal 21 to perform operations.

In this case, the application specific logic circuit 4 outputs an initialization signal to the control circuit of a recording head and a driving circuit for driving a motor.

Figure 5:
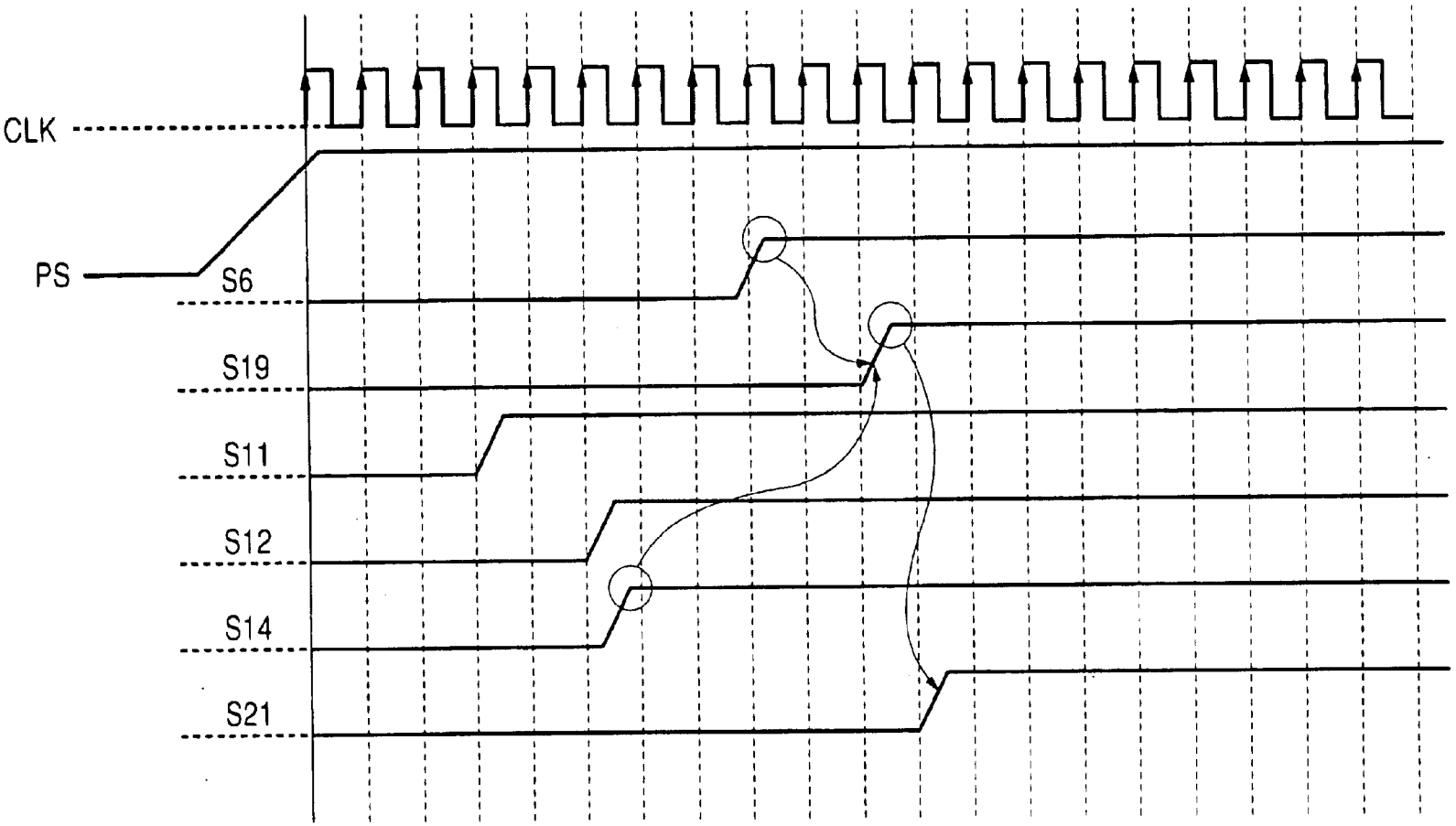
FIG. 5 is an operation-timing chart of the configuration of the second embodiment.

FIG. 5 is a timing chart for explaining the initialization of the second embodiment shown in FIG. 4.

Symbol CLK denotes a clock signal to be input to the ASIC 1. Symbol PS denotes a voltage waveform of the power to be supplied from the power-source unit 33 to the ASIC.

Symbol S6 denotes the waveform of the reset signal 6. In S6, the slash portion is a voltage area in which operations of the ASIC 1 are not assured and operations of circuit blocks in this portion are unstable. The reset IC changes S6 from L level to H level when a predetermined period passes after monitoring PS and detecting a specified voltage or higher.

Symbol S19 denotes the waveform of the enable permission signal 19. Symbol S11 denotes the waveform of an initialization completion signal output by the peripheral logic circuit. Symbol S12 denotes the waveform of an initialization completion signal output by the application specific logic circuit. Symbol S14 denotes the waveform of the initialization-completion notification signal 14. Symbol S21 denotes the waveform of the enable signal 21.

Transition of a signal waveform is described below. When power is supplied from the power-source unit 33 described with respect to FIG. 3, the reset IC keeps the reset signal S6 at L level while monitoring the power-source voltage and counting voltages equal to or higher than a predetermined voltage until a predetermined time passes.

However, because the above counting operation depends on the reset IC for generating a reset signal, the operation does not synchronize with the clock of the ASIC 1.

The peripheral logic circuit 3 and application specific logic circuit 4 are initialized in accordance with a clock signal CLK while the reset signal S6 is kept at L level. After the circuits 3 and 4 are initialized, they change the initialization completion signals 11 and 12 from L level to H level.

The AND circuit 13 performs AND operation sets the initialization-completion notification signal 14 to H level, and outputs the H level signal 14 to the CPU. Thereby, the CPU confirms that the peripheral logic circuit and application specific logic circuit are normally initialized.

Then, the CPU 2 confirms that the reset signal S6 is kept at H level and sets the enable permission signal S19 to H level. Then, outputs of AND elements 20*a* and 20*b* are changed from L level to H level and the clock-synchronized enable signal S21 is changed to H level. Thereby, operations of the peripheral logic circuit 3 and application specific logic circuit 4 are permitted.

Though timings at which operations of the peripheral logic circuit 3 and application specific logic circuit 4 are permitted are described above by referring to FIG. 5, another timing is described below by referring to FIG. 6.

First, the timing at which the CPU 2 receives the initialization-completion notification signal 14 is described. The CPU changes the enable permission signal 19 from L level to H level. Thereafter, when the reset signal S6 changes from L level to H level, the AND elements 20*a* and 20*b* output H level signals and the F/F circuits 9*b* and 9*c* change the enable signal 21 from L level to H level. Thus, the CPU permits operations of the peripheral logic circuit 3 and application specific logic circuit 4.

Figure 6:
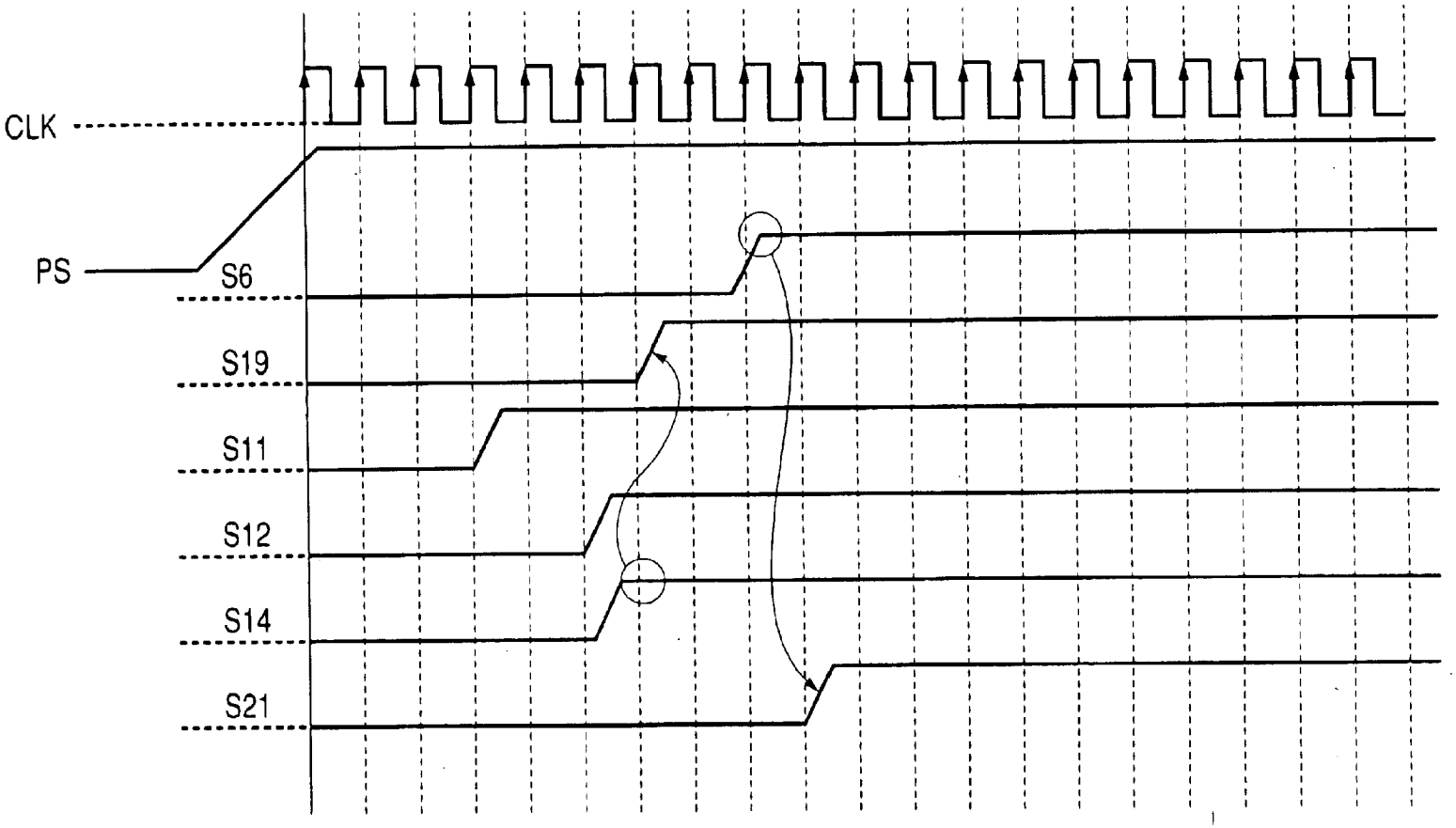
FIG. 6 is an operation-timing chart of the configuration of the second embodiment.

Thus, according to FIGS. 5 and 6, the CPU can permit operations of the peripheral logic circuit 3 and application specific logic circuit 4 even if the timing at which the reset signal 6 changes from L level to H level precedes or follows the timing at which the enable permission signal 19 changes from L level to H level. That is, the CPU securely operates the initialized peripheral logic circuit 3 and application specific logic circuit 4 without depending on the timing of the reset signal.

Moreover, the initialization completion signals S11 and S12 may not change from L level to H level even after a predetermined period passes. In this case, because it is impossible to permit operations of the peripheral logic circuit 3 and application specific logic circuit 4, the CPU attempts to initializes the peripheral logic circuit 3 and application specific logic circuit 4.

Figure 7:
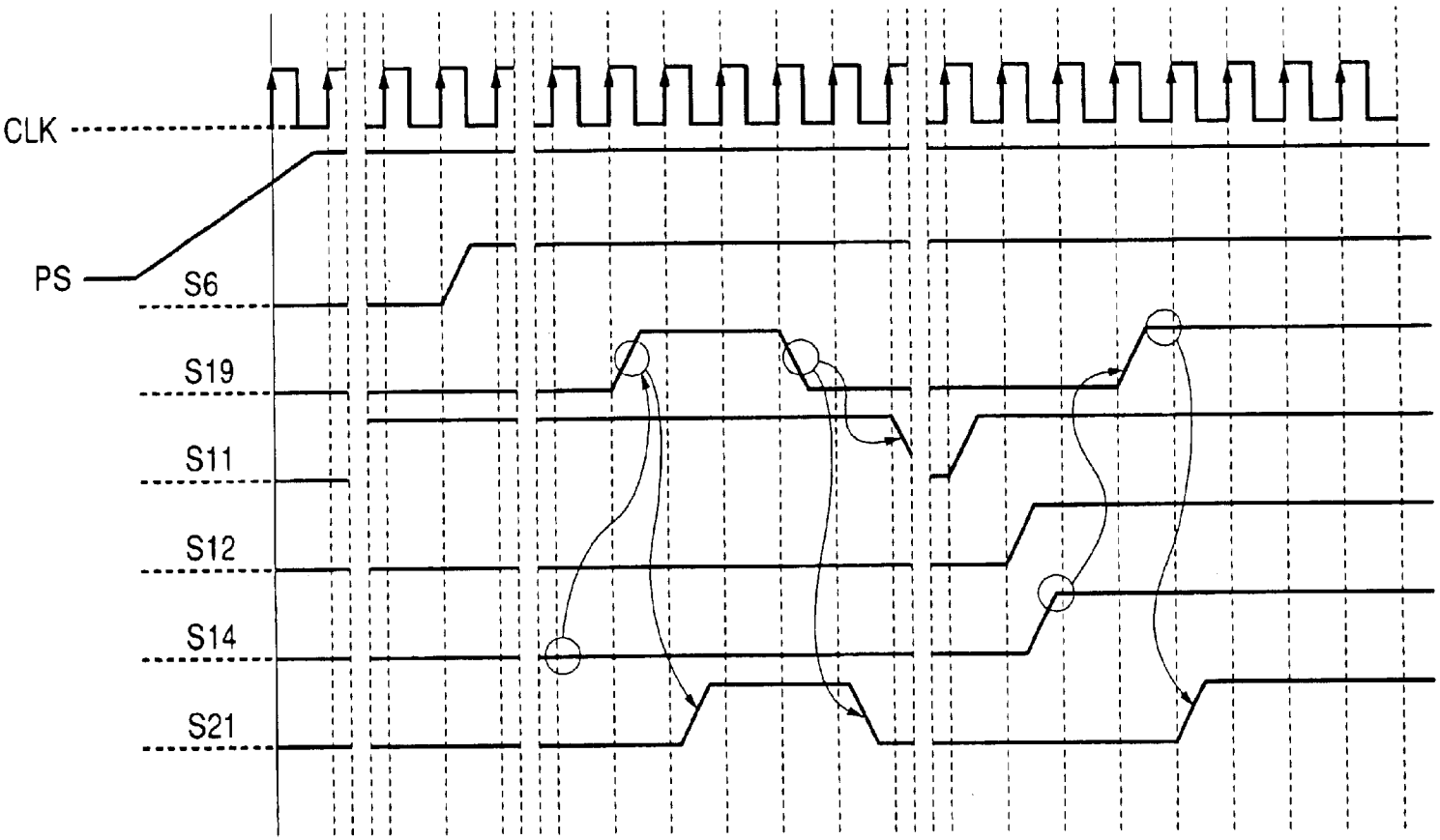
FIG. 7 is an operation-timing chart of the configuration of the second embodiment.

FIG. 7 explains the flow of the above control. When PS rises, the reset signal S6 keeps L level for a predetermined period (period in which internal circuits can be sufficiently initialized) and then, changes to H level. Because the initialization completion signal S12 does not change from L level to H level, the CPU temporarily changes the enable permission signal S19 from L level to H level. Then, the CPU changes the signal S19 from H level to L level after a predetermined period (after three clocks of CLK signal).

Thereby, the enable signal S21 changes from L level to H level. However, the signal 21 changes from H level to L level again after three clocks. Because the enable signal changes to L level, the initialized peripheral logic circuit and application specific logic circuit are initialized again and the initialization completion signals S11 and S12 are changed to L level.

In this case, the peripheral logic circuit samples clock signals while the initialization completion signal S11 is kept at L level by clock means (not shown) in the LSI and starts counting. The application specific logic circuit also starts counting while the initialization completion signal S12 is kept at L level.

Then, when the counted number reaches a predetermined value, the peripheral logic circuit changes the initialization completion signal S11 from L level to H level. The application specific logic circuit also changes the initialization completion signal S12 from L level to H level when the counted number reaches a predetermined value.

Thereby, the CPU can confirm that initialization of the peripheral logic circuit and application specific logic circuit is completed. Then, as described with respect to FIG. 5, the CPU 2 operates the peripheral logic circuit and application specific logic circuit.

Thus, because the CPU initializes the peripheral logic circuit and application specific logic circuit again when initialization of the circuits is not completed, it is possible to realize secure operations of an integrated circuit.

Figure 8:
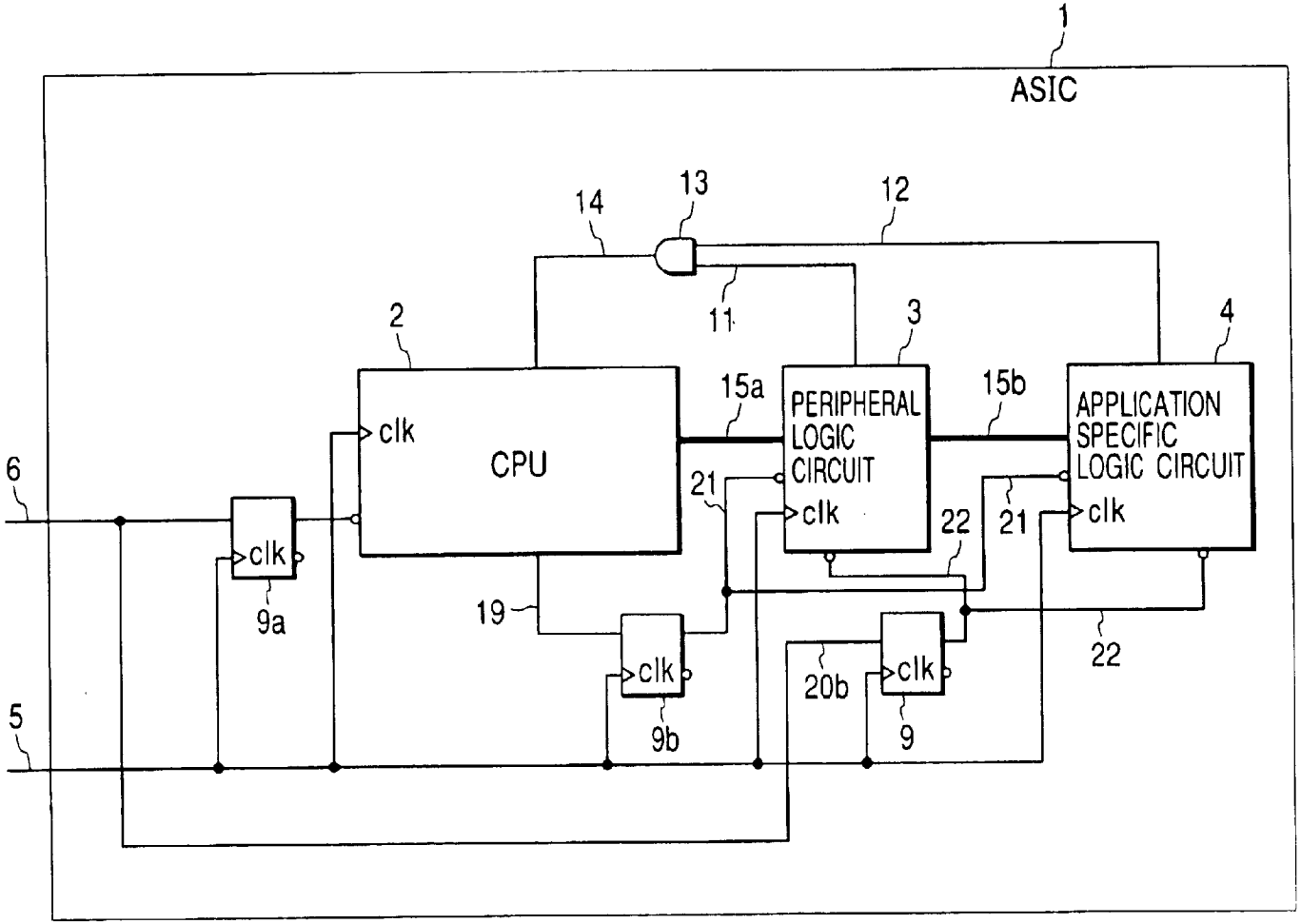
FIG. 8 is a block diagram showing a configuration of a third embodiment.

FIG. 8 is a block diagram showing a configuration of a third embodiment. Each circuit component having the same function as a corresponding component of the above-mentioned embodiments is identified by the same reference numeral and its description is omitted.

Symbol 6 denotes a reset signal supplied to the ASIC 1 from an external unit. An F/F circuit 9*d* outputs a reset sync signal 22 obtained by synchronizing the reset signal 6 with a clock to the peripheral logic circuit 3 and application specific logic circuit 4.

Figure 9:
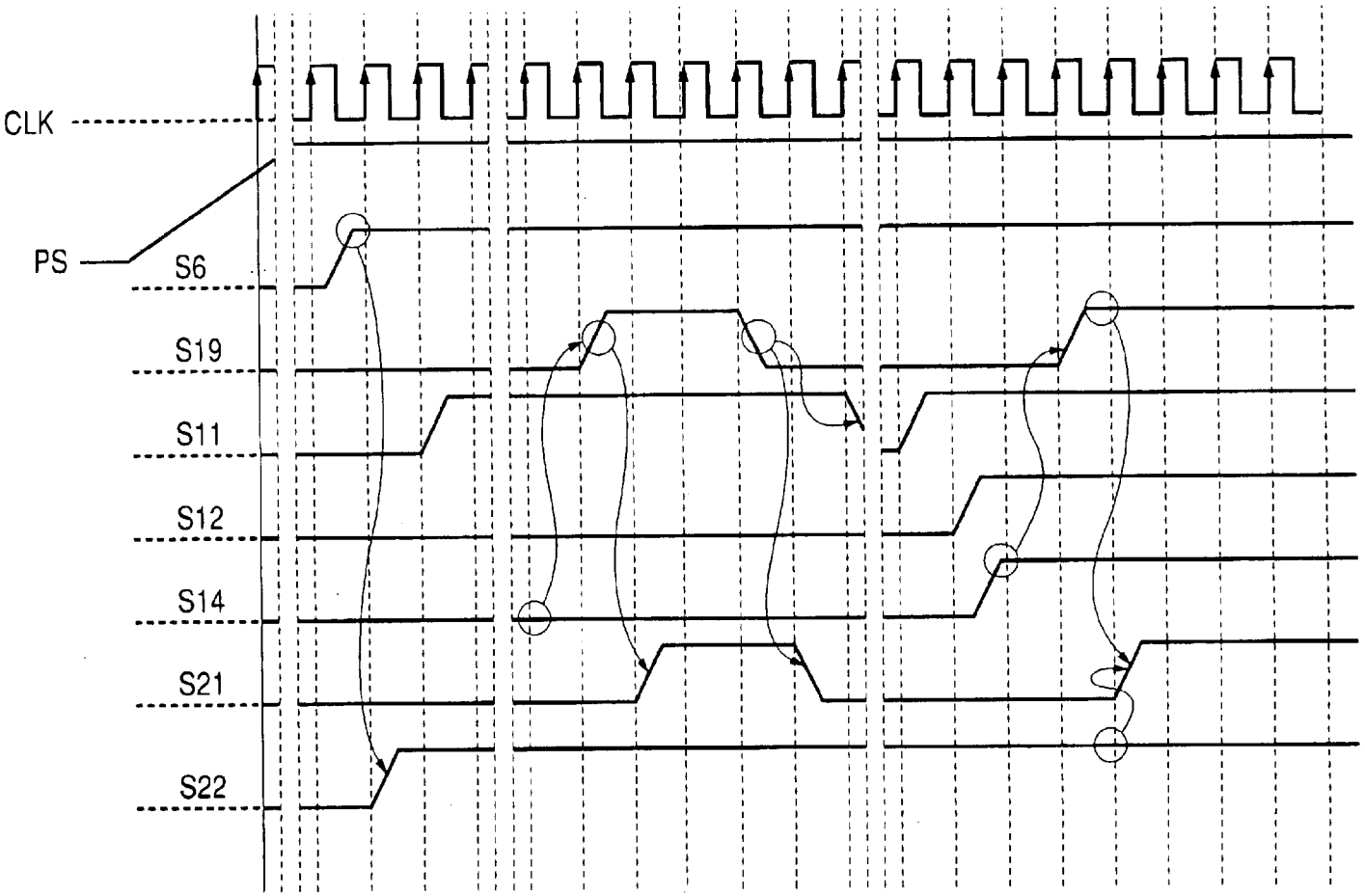
FIG. 9 is an operation-timing chart of the configuration of the third embodiment.

FIG. 9 shows a configuration of the third embodiment shown in FIG. 8. A case is described below in which the initialization completion signal S12 output from the application specific logic circuit does not change from L level to H level even after a predetermined period passes.

As described with reference to FIG. 7, when PS rises, the reset signal S6 keeps L level for a predetermined period and then changes to H level. After the reset signal S6 changes to H level, a synchronized reset signal S22 changes from L level to H level.

Because the initialization completion signal S12 does not change from L level to H level, the CPU 2 temporarily changes an enable signal from L level to H level and then, changes the enable signal from H level to L level after a predetermined period.

Thereby, the enable signal S21 changes from L level to H level but changes from H level to L level again after three clocks. The enable signal 21 is set to L level, the peripheral logic circuit and application specific logic circuit are reset, and the initialization completion signals S11 and S12 are set to L level.

Thereafter, the peripheral logic circuit and application specific logic circuit start counting while the initialization completion signals S11 and S12 are kept at L level. When the counted number reaches a predetermined value, the peripheral logic circuit and application specific logic circuit change the initialization completion signals S11 and S12 from L level to H level.

Thereby, the initialization completion notification signal S14 changes from L level to H level to show that the peripheral logic circuit and application specific logic circuit are initialized. When the CPU confirms the initialization-completion notification signal S14, it also changes the enable permission signal S19 to H level.

Then, the CPU confirms that the synchronized reset signal S22 is kept at H level, changes the enable signal S21 from L level to H level, and permits operations.

Thereby, the CPU confirms that the peripheral logic circuit and application specific logic circuit are initialized and moreover confirms the state of the reset signal and thereby, securely operates the peripheral logic circuit and application specific logic circuit.

Figure 10:
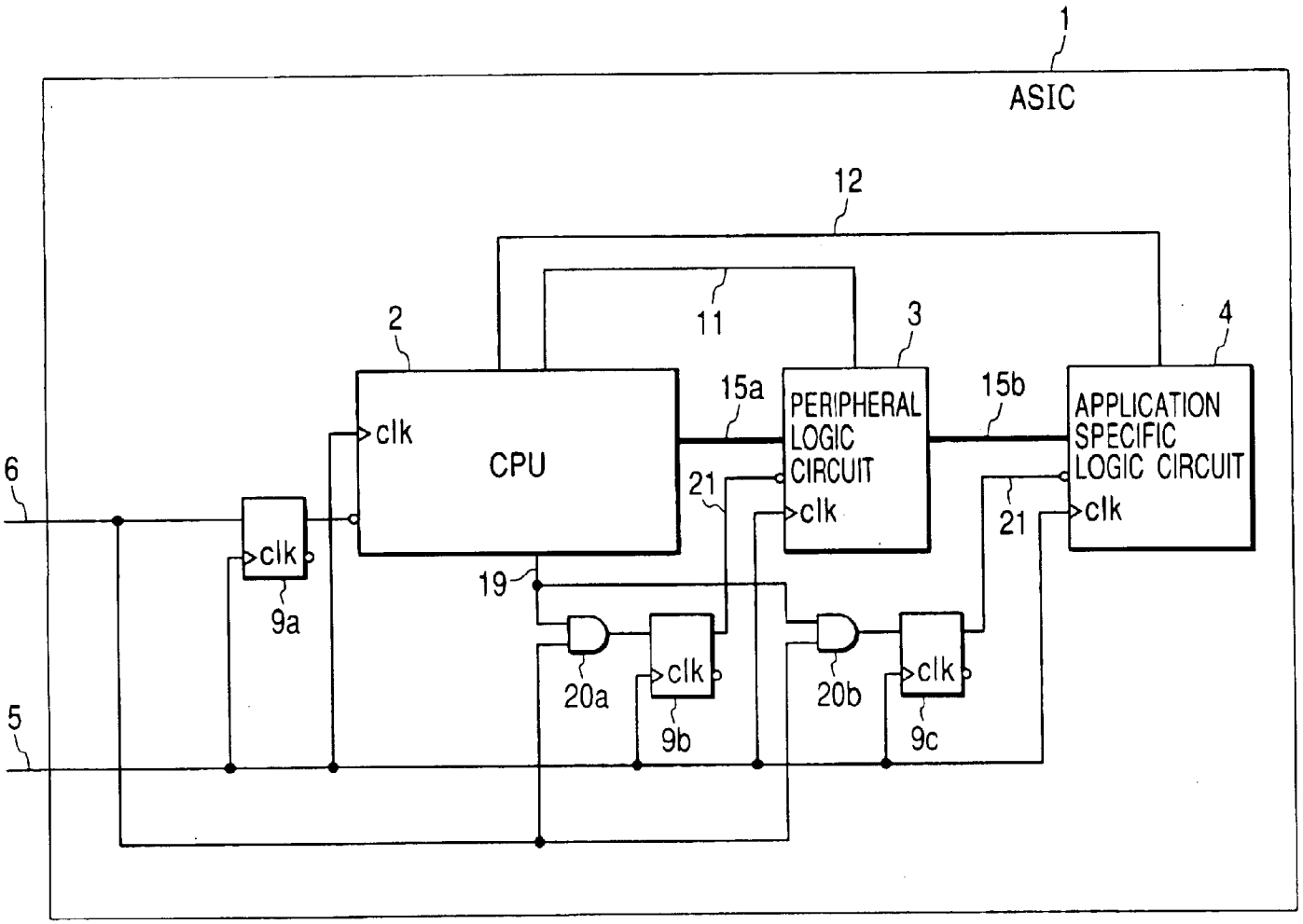
FIG. 10 is a block diagram showing a configuration of a fourth embodiment.
Figure 11:
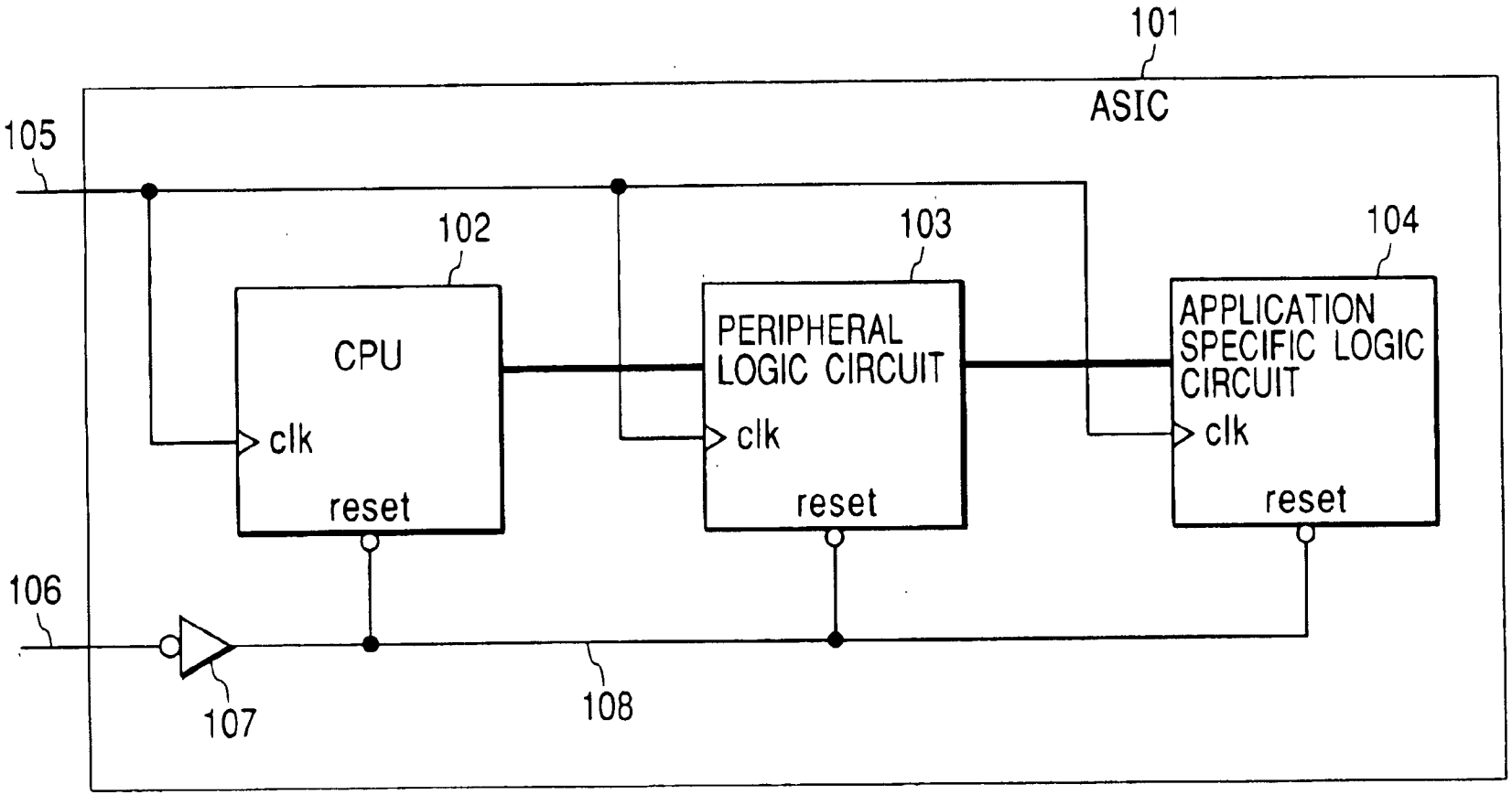
FIG. 11 is a block diagram showing a configuration of a conventional ASIC.

FIG. 10 is a block diagram showing a configuration of a fourth embodiment. In FIG. 10, each circuit component having the same function as a corresponding component of the previously described embodiments is identified by the same reference numeral and its description is omitted, whereas different components are described below.

Symbol 11 denotes an initialization completion signal output from the peripheral logic circuit 3 and 12 denotes an initialization completion signal output from the application specific logic circuit 4. The CPU 2 has two ports for inputting initialization completion signals.

These two ports input initialization completion signals 11 and 12. The CPU 2 performs the AND operation of signals input to the two ports and confirms that initialization of the peripheral logic circuit 3 and application specific logic circuit 4 is completed.

The first to fourth embodiments of a large-scale integrated-circuit apparatus serving as a printer control circuit are described above. However, it is permitted for the large-scale integrated-circuit apparatus to have not only one application specific logic-circuit but also two application specific circuits or more.

While processing of print data and control signals for the recording head have been described exemplarily, the application specific logic circuit 4 may control communication with a host computer.

The application specific logic circuit 4 receives the enable signal 21 and thereafter outputs an initialization signal to the recording unit control circuit and motor driving circuit. However, the output timing is not restricted to the above timing. For example, it is permitted for the application specific logic circuit 4 to output an initialization signal to the recording unit control circuit and motor driving circuit in accordance with a designation supplied from the CPU at a predetermined timing. Moreover, it is permitted for the application specific logic circuit 4 to output an initialization signal to the recording-unit control circuit and motor driving circuit after outputting an initialization completion signal.

For the arrangement of the ASIC, it is described that the application specific logic circuit 4 is more separate from the CPU than the peripheral logic circuit 3. Even when considering the height-directional distance in the ASIC 1 the application specific logic circuit 4 is more separate from the CPU than the peripheral logic circuit 3.

Moreover, though the logic operation element for logic-operating initialization completion signals supplied from the peripheral logic circuit and application specific logic circuit has two inputs, the number of inputs is not restricted to two. For example, when a large-scale integrated circuit is constituted of a CPU, a peripheral logic circuit, and two specific logic circuits, it is permitted to use a logic operation circuit for inputting three initialization completion signals.

Moreover, in the case of the timing of an initialization completion signal of the embodiments, S11 changes from L level to H level before S12. However, the change sequence is not restricted to the above sequence. It is also permitted that S12 changes from L level to H level before S11.

Furthermore, though the recording head uses a system of heating a heater and discharging ink, it is permitted to use a recording head constituted of a piezoelectric element. Furthermore, though the recording head has 128 nozzles, it is permitted to use 256 nozzles instead of 128 nozzles. Furthermore, it is permitted for the recording head to have a resolution of 1,200 DPI without restricting the resolution to 600 DPI.

As a configuration of the printer, the serial type in which a carriage reciprocates to perform recording is described as an example. However, the configuration is not restricted to the serial type. It is permitted to use a printer constituted of a full-line-type recording head having a length corresponding to the width of a maximum-size recording medium on which the printer can record data.

What is claimed is:

1. An integrated-circuit apparatus comprising:

a CPU and a plurality of circuit blocks to be initialized in accordance with external reset signals and external clock signals, wherein the circuit blocks each respectively output an initialization completion signal for communicating completion of initialization after the circuit blocks are initialized, the CPU outputs an enable signal for permitting operations of the circuit blocks in accordance with the initialization completion signals output from the circuit blocks, the circuit blocks are permitted to perform the operations by the enable signal, the external reset signals and the external clock signals, and if there is any circuit block that is not initialized yet, the CPU initializes the circuit block by using the enable signal.

2. The integrated-circuit apparatus according to claim 1, wherein the circuit blocks are initialized to output the initialization completion signals, and said apparatus further comprises a logic circuit for inputting the initialization completion signals output from the circuit blocks to logic-operate the signals, and outputting the logic-operation results to the CPU.

3. The integrated-circuit apparatus according to claim 2, wherein when all of the circuit blocks are initialized, the CPU outputs the enable signal to all the circuit blocks.

4. The integrated-circuit apparatus according to claim 1, wherein when all of the circuit blocks are initialized, the CPU outputs the enable signal to all the circuit blocks.

5. The integrated-circuit apparatus according to claim 1, wherein the circuit blocks output the initialization completion signals when a predetermined period passes after the reset signal is input.

6. The integrated-circuit apparatus according to claim 5, wherein the integrated-circuit apparatus is constituted of one chip.

7. The integrated-circuit apparatus according to claim 6, wherein the integrated-circuit apparatus is used for a printer.

8. The integrated circuit apparatus according to claim 5, wherein the integrated-circuit apparatus is used for a printer.

9. The integrated-circuit apparatus according to any one of claims 1 to 3, wherein the integrated-circuit apparatus is constituted of one chip.

10. The integrated-circuit apparatus according to claim 9, wherein the integrated-circuit apparatus is used for a printer.

11. The integrated-circuit apparatus according to any one of claims 1 to 3, wherein the integrated-circuit apparatus is used for a printer.

12. An ink-jet recording apparatus comprising:

an integrated-circuit apparatus for controlling recording using a recording head, wherein the integrated-circuit apparatus comprises a CPU and a plurality of circuit blocks to be initialized in accordance with external reset signals and external clock signals, the circuit blocks each respectively output an initialization completion signal for communicating completion of initialization after the circuit blocks are initialized, the CPU outputs an enable signal for permitting operations of the circuit blocks in accordance with the initialization completion signals output from the circuit blocks, the circuit blocks are permitted to perform the operations by the enable signal, the external reset signals and the external clock signals, and each of the circuit blocks is provided with a circuit to which the enable signal output from the CPU and the reset signals are input to be synchronized by the clock signals and the circuit outputs the enable signal to the circuit blocks.

13. The ink-jet recording apparatus according to claim 12, wherein the recording head comprises a control circuit and the circuit blocks each respectively output a signal for initializing the control circuit.

14. The ink-jet recording apparatus according to claim 12, further comprising a driving circuit for performing the recording and the circuit blocks each respectively output a signal for initializing the driving circuit.

15. A control method of an integrated-circuit apparatus having a CPU and a plurality of circuit blocks to be initialized in accordance with external reset signals and external clock signals, comprising the steps of:

initializing the circuit blocks;

outputting an initialization completion signal for communicating completion of initialization in the initializing step;

outputting an enable signal for permitting operations of the circuit blocks in accordance with the signal output in the initialization completion signal outputting step;

permitting the circuit blocks to perform the operations by the enable signal, the external reset signals and the external clock signals; and if there is any circuit block that is not initialized yet, initializing the circuit block by using the enable signal.

16. An integrated-circuit apparatus comprising:

a CPU and a plurality of circuit blocks to be initialized in accordance with external reset signals and external clock signals, wherein the circuit blocks each respectively output an initialization completion signal for communicating completion of initialization after the circuit blocks are initialized, the CPU outputs an enable signal for permitting operations of the circuit blocks in accordance with the initialization completion signals output from the circuit blocks, the circuit blocks are permitted to perform the operations by the enable signal, the external reset signals and the external clock signals, and each of the circuit blocks is provided with a circuit to which the enable signal output from the CPU and the reset signals are input to be synchronized by the clock signals and the circuit outputs the enable signal to the circuit blocks.

* * * * *

UNITED STATES PATENT AND TRADEMARK OFFICE

CERTIFICATE OF CORRECTION

PATENT NO. : 6,752,480 B2
DATED : June 22, 2004
INVENTOR(S) : Watanabe

It is certified that error appears in the above-identified patent and that said Letters Patent is hereby corrected as shown below:

Column 1,
Line 54, “above mentioned” should read -- above-mentioned --.

Column 3,
Line 49, “out put” should read -- output --.

Column 4,
Line 3, “high active” should read -- high-active --, and “Symbol 7” should begin a new paragraph.
Line 5, “signal,of” should read -- signal of --.

Column 5,
Line 13, “signaled” should read -- signal 5 --.

Column 7,
Line 59, “operation” should read -- operation, --.

Column 8,
Line 30, “initializes” should read -- initialize --.

Column 11,
Lines 40 and 47, “1 to 3,” should read -- 1 to 4, --.

Signed and Sealed this

Seventeenth Day of May, 2005

JON W. DUDAS
*Director of the United States Patent and Trademark Office*